US006813913B2

(12) United States Patent
Watts

(10) Patent No.: US 6,813,913 B2
(45) Date of Patent: Nov. 9, 2004

(54) PADLOCKS

(75) Inventor: John Russell Watts, South Melbourne (AU)

(73) Assignee: Yarra Ridge Pty., Ltd., South Melbourne (AU)

( * ) Notice: Subject to any disclaimer, the term of this patent is extended or adjusted under 35 U.S.C. 154(b) by 0 days.

(21) Appl. No.: 09/883,131

(22) Filed: Jun. 15, 2001

(65) Prior Publication Data

US 2002/0007654 A1 Jan. 24, 2002

(30) Foreign Application Priority Data

| | | |
|---|---|---|
| Jun. 15, 2000 | (AU) | PQ8160 |
| Jun. 15, 2000 | (AU) | PQ8166 |
| Aug. 23, 2000 | (AU) | PQ9602 |
| Feb. 6, 2001 | (AU) | PR2871 |
| Apr. 27, 2001 | (AU) | PR4650 |

(51) Int. Cl.[7] ..... E05C 67/00
(52) U.S. Cl. ..... 70/38 A; 70/20; 70/31; 70/35
(58) Field of Search ..... 70/31, 35, 38 A, 70/20

(56) References Cited

U.S. PATENT DOCUMENTS

| | | | |
|---|---|---|---|
| 1,424,543 A | 8/1922 | Wiloch | |
| 1,607,758 A | 11/1926 | Junkunc | |
| 1,636,381 A | 7/1927 | Megie et al. | |
| 1,660,903 A | 2/1928 | Adamson | |
| 1,902,665 A | 3/1933 | Reinhold | |
| 2,460,615 A | 2/1949 | Andrew | 70/369 |
| 2,691,288 A | 10/1954 | Childs | 70/38 |
| 3,143,872 A | 8/1964 | Check | 70/38 |
| 4,138,868 A | 2/1979 | Richards, Sr. | 70/38 A |
| 4,158,952 A | 6/1979 | Oliver et al. | 70/52 |
| 4,290,279 A | 9/1981 | Fish et al. | 70/38 A |
| 4,290,280 A | 9/1981 | Yun | 70/38 A |
| 4,528,828 A | 7/1985 | Poutiainen | 70/38 A |
| 4,841,753 A | 6/1989 | Patton | 70/38 C |
| 4,938,039 A | 7/1990 | Tzung-I | 70/38 A |
| 4,955,932 A | 9/1990 | Kofman | 70/39 |
| 4,998,422 A | 3/1991 | Borgmann et al. | 70/38 A |
| 5,174,136 A | 12/1992 | Thwing | 70/38 A |
| 5,189,893 A | 3/1993 | Kortenbrede | 70/38 A |
| 5,363,678 A | 11/1994 | Meckbach | 70/38 A |
| 5,377,511 A | 1/1995 | Meckbach | 70/38 A |
| 5,572,890 A | * 11/1996 | Carpenter | 70/371 |
| 5,896,761 A | 4/1999 | Chen | 70/38 A |
| 6,145,356 A | 11/2000 | Thwing | 70/389 |

FOREIGN PATENT DOCUMENTS

| | | |
|---|---|---|
| CA | 970987 | 7/1975 |
| GB | 2103706 A | 2/1983 |

* cited by examiner

*Primary Examiner*—Daniel P. Stodola
*Assistant Examiner*—Carlos Lugo
(74) *Attorney, Agent, or Firm*—Sughrue Mion, PLLC

(57) ABSTRACT

A padlock is provided with a shackle having a short leg with a first locking recess and a longer leg with an opposed locking recess and a casing having a short and longer recess extending into the casing from a first end to accept the short and long shackle legs respectively. A central recess extends into the casing from the opposite end in and offset recess extends into the casing and intersects the central recess. A transverse recess extends into the casing from one side and intersects the short, longer and central recesses. A cylinder having a key operable barrel is disposed in the body and two opposed balls are supporting within the transverse recess which are capable of protruding into the recesses in the shackle legs respectively. A cam is provided to control the balls and a coupler to facilitate operable coupling between the cam the cylinder. The coupler is mountable within the body to provide a Type 1 padlock or a Type 2 padlock.

17 Claims, 8 Drawing Sheets

Figures 1-4
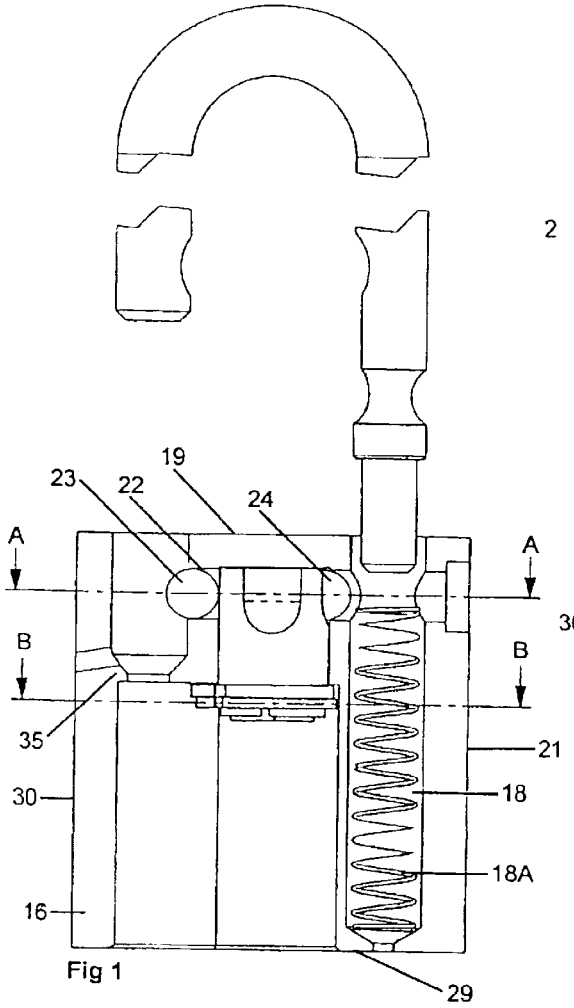
Fig 1
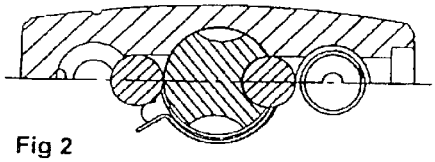
Fig 2
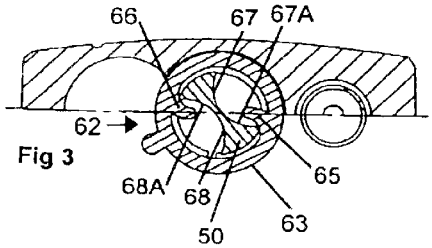
Fig 3
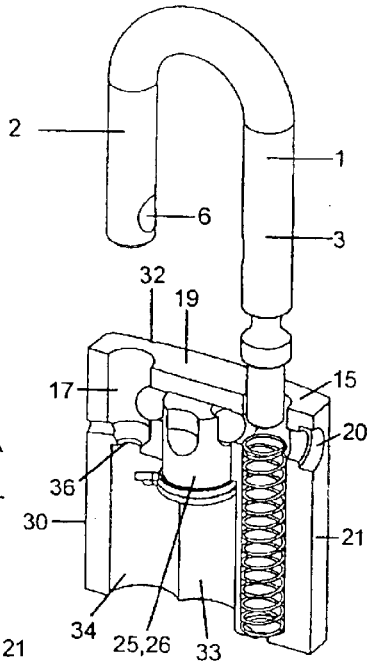
Fig 4

Figures 5-8
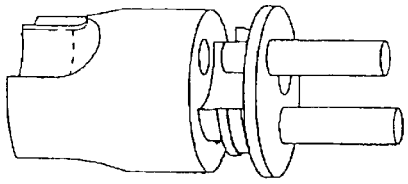
Fig 7
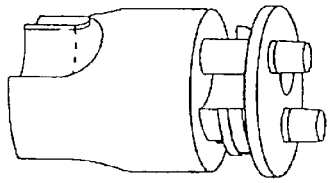
Fig 8
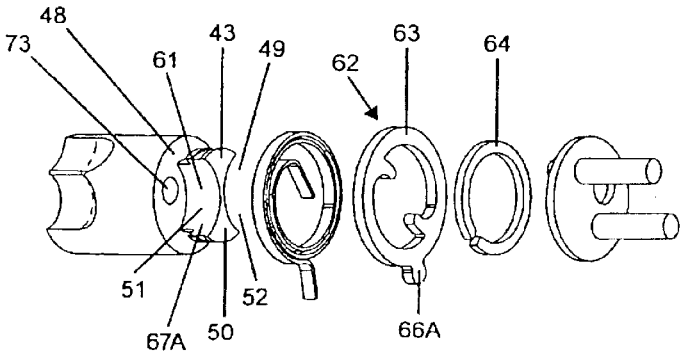
Fig 6
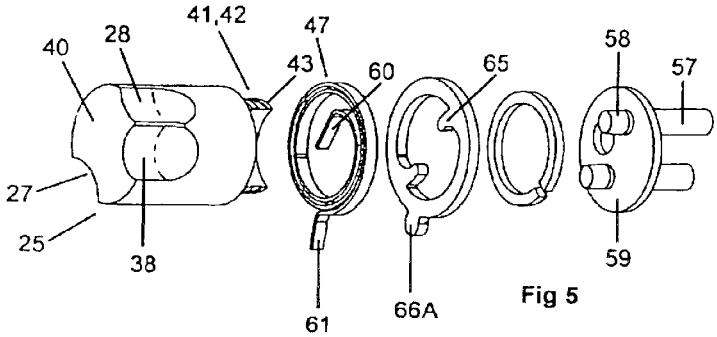
Fig 5

Figures 9-12
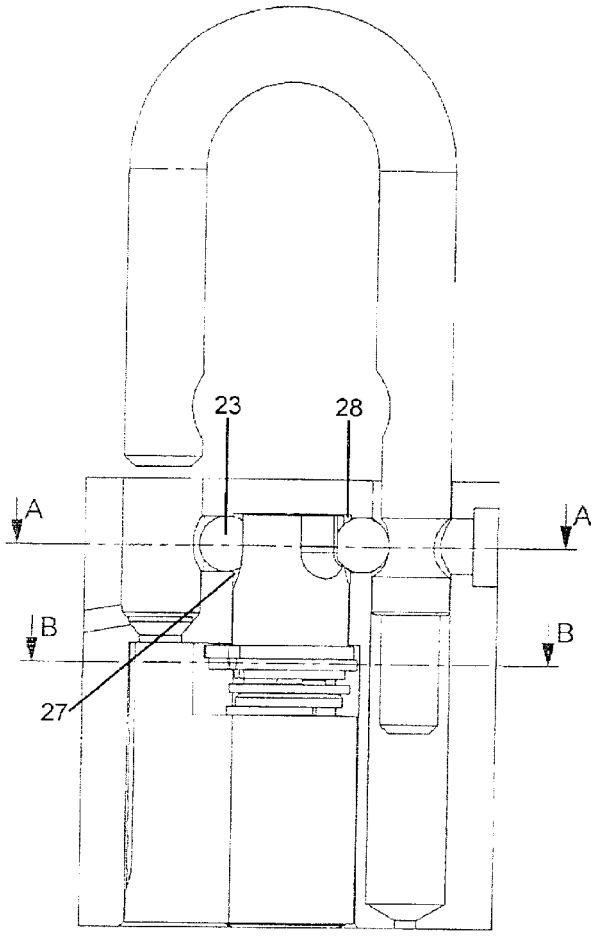
Fig 9
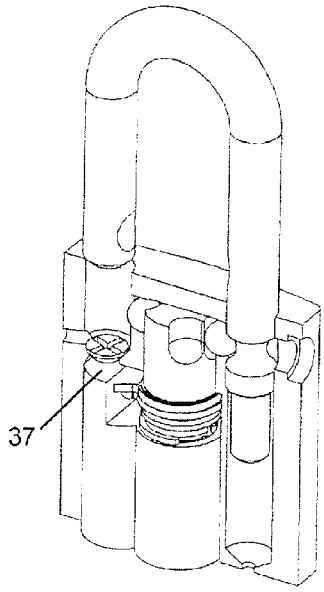
Fig 12
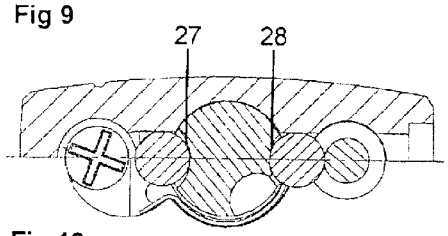
Fig 10
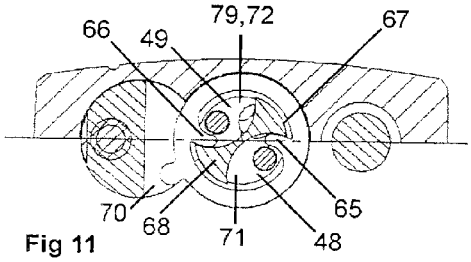
Fig 11

Figures 13-16
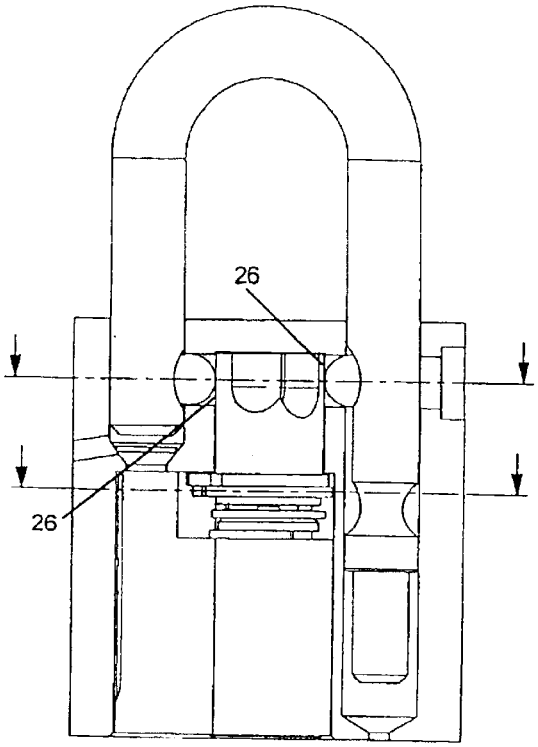
Fig 13
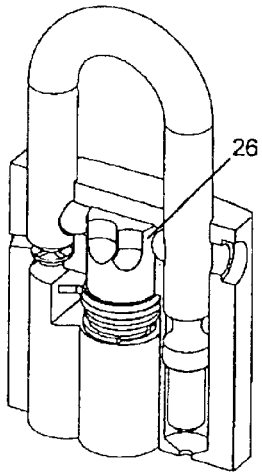
Fig 16
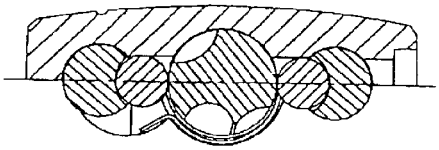
Fig 14
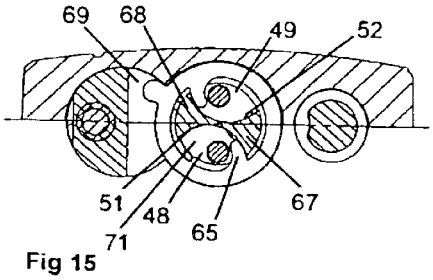
Fig 15

PADLOCKS

FIELD OF THE INVENTION

This invention relates to padlocks, cylinder locks and other locks In this specification, where a document, act or item of knowledge is referred to or discussed, this reference or discussion is not an admission that the document, act or item of knowledge or any combination thereof was at the priority date, publicly available, known to the public, part of the common general knowledge or known to be relevant to an attempt to solve any problem with which this specification is concerned.

Padlocks, cylinder locks are well known types of locks. Furthermore, there are many patents and patent applications relating to locks such as, for example, AU 51912/93 and AU 52587/93.

AU 52587/93 describes a padlock having an extra deep recess for a second ball to enable shackle removal. The shackle is specifically described as a conventional shackle having notched locking recesses. The padlock includes a flat between the second locking recess and peripheral recess, as is common. The locking recesses and flat as described and depicted in AU 52587/93 are produced by notching—more correctly called broaching—which is a process quite different from machining. One of the problems associated with this type of padlock is that it is weakened by the amount of material removed during manufacture.

AU 51912/93 prelates to a padlock having a float, free movement between the cylinder barrel and an optional part between the barrel and cam to eliminate the float and convert between a Type 1 and Type 2 padlock. Furthermore this padlock has a stop on the barrel to limit its rotation.

The padlocks of both 52587/93 and 51912/93 employ triangular shoulders projecting from the end of the barrel and end of the cam to mate with free movement with each other unless the 'play-take-up bridge' is positioned between the two sets of shoulders.

SUMMARY OF THE INVENTION

According to the invention there is provided a padlock, including a shackle having a short leg with a first locking recess and a longer leg having an opposed second locking recess, said longer leg being connected by a longitudinally elongated recess or flat to a peripheral recess disposed towards the end of the longer leg, and a casing having a short and a longer recess extending into the casing from a first end surface to accept the short and longer shackle leg respectively, a central recess extending into the casing from an opposed second end surface, an offset recess extending into the casing from the opposed second end surface and intersecting the central recess, the intersection defining a first and a second longitudinally elongated cusp portion, said short, longer and central recesses being intersected by a transverse recess extending into the casing from a first side of the casing, a cylinder having a key operable barrel characterised by an undisplaced position enabling key removal, two opposed balls supported within the transverse recess; a first ball able to protrude into the short recess and first locking recess and a second ball to protrude into the longer recess and second locking recess, a cam to control the balls, and a coupler to facilitate operable coupling between the cam and the cylinder, the coupler being mountable within the body to provide a Type 1 padlock characterised by an unlocked, open configuration where short leg is free of the casing, the longer leg is supported in the casing and the key is removable, the coupler being mountable within the body to provide a Type 2 padlock characterised by an unlocked, open configuration where the short leg is free of the body, the longer leg is supported in the body casing and the key and barrel cannot be rotated to the undisplaced position to enable key removal.

According to the invention there is further provided a padlock, including a shackle having a short leg with a first locking recess and a longer leg having an opposed second locking recess, said longer leg being connected by a longitudinally elongated recess or flat to a peripheral recess disposed towards the end of the longer leg, and a casing having a short and a longer recess extending into the casing from a first end surface to accept the short and longer shackle leg respectively, a central recess extending into the casing from an opposed second end surface, an offset recess extending into the casing from the opposed second end surface and intersecting the central recess, the intersection defining a first and a second longitudinally elongated cusp portion, said short, longer and central recesses being intersected by a transverse recess extending into the casing from a first side of the casing, a cylinder having a key operable barrel characterised by an undisplaced position enabling key removal, two opposed balls supported within the transverse recess; a first ball able to protrude into the short recess and first locking recess and a second ball to protrude into the longer recess and second locking recess, a cam to control the balls, the angular disposition of the cam in the locking and unlocking configurations being determined by a stop comprising a disc-like member supported coaxially with and relative to the cam, and being angularly displaceable relative to the cam, and having a stop shoulder which protrudes into the offset recess, said stop having a first operative configuration where the stop shoulder abuts the wall of the offset recess adjacent the first cusp and a second operative configuration where the stop shoulder abuts the opposite wall of the offset casing adjacent second cusp, the padlock being characterised by:

a closed, locked configuration corresponding to the stop being in the first operative configuration, the short and longer legs being supported in the casing and restrained from displacing relative to the casing, the cam being in a locking configuration and retaining the first ball partly within the first locking recess and the second ball being partly within the second locking recess, the cam and stop member being rotatable in an unlocking direction by the cylinder to displace the padlock to an unlocked configuration, and an open, unlocked configuration corresponding to the stop being in the second operative configuration, the short leg being free of the casing, the longer leg being supported in the casing, the cam being in an unlocking configuration and retaining the second ball partly within the longitudinally elongated recess or flat or partly within the peripheral recess.

The shackle of the present invention differs in many respects from padlocks such as those described in prior art document AU 51912/93 including the fact that the present invention is stronger because less material need be removed during manufacture of the padlock of the present invention.

Furthermore, the padlock of the present invention differs from padlocks such as those described in AU 52587/93 because the present invention only requires inversion of a coupler to convert between Type 1 and Type 2 padlocks. The present invention does not limit the rotation of the barrel and therefore is applicable to interchangeable core where commonly the barrel has pin holes and is unrestrained.

Preferably, the cam includes a first cam portion comprising a substantially cylindrical portion defined by a peripheral, side, curved surface and having a longitudinal axis coaxial with the cam axis of rotation and which is parallel with and between the longitudinal axii of the short and longer recess in the casing, said cam in a locking configuration presenting the curved surface to each ball to retain the balls in the locking recesses, said cam in the unlocking configuration presenting a longitudinally elongated, side, first unlocking recess to the first ball and a longitudinally elongated, side, second unlocking recess to the second ball to enable the first ball to be removed from the first locking recess and the second ball to be partly removed from the second locking recess and be retained partly within the longitudinally elongated recess or the flat or partly within the peripheral recess.

Preferably the first cam portion is integrally connected to a cam drive portion relatively disposed towards the casing second end surface, said drive portion comprising two opposed drive recesses having coplanar floors wherein the plane is orthogonal to the axis of rotation of the cam, said drive recesses being on opposite sides of the cam axis of rotation and being defined by an axial between bridge comprising opposed walls, each wall having a first engagable drive shoulder at one end and a second engagable shoulder at the other end, said bridge having opposed part cylindrical portions to support the disc-like member which has an aperture of substantially circular cross-section interrupted by at least one inwardly protruding finger engageable with the first drive shoulder, wherein each finger abuts the first drive shoulder when the cam is in the locked and unlocked configurations.

Preferably, the padlock when configured as a Type 1 padlock, includes at least one drive pin supported within the cylinder barrel to extend into the space between the at least one finger and second drive shoulder to be engageable with the at least one finger, to enable the pin to be displaced about the cylinder barrel axis of rotation to displace the first drive shoulder and the interposed finger to the unlocking configuration, and the barrel and key to subsequently be returned to the undisplaced position while the drive pin correspondingly displaces freely within the space between the at least one finger and second drive shoulder.

Preferably, the padlock when configured as a Type 2 padlock, includes at least one drive pin supported within the cylinder barrel to extend through the space between the at least one finger and second drive shoulder to protrude into a pin recess within the floor of the drive recess and adjacent the finger, to enable the pin to be displaced about the cylinder barrel axis of rotation to displace the first drive shoulder and the interposed finger to the unlocking configuration, the barrel and key being unable to be returned to the undisplaced position because of the direct coupling between the drive pin and cam.

Preferably, there is an opposed pair of fingers, an opposed pair of drive shoulders, opposed drive recesses with pin holes and there is correspondingly an opposed pair of drive pins, said drive pins having passage through while being supported in a support disc to comprise a coupler, the drive pins being configured to protrude more from one side of the disc than the other and additionally being configured so that when assembled into the padlock body with the longer ends towards the cam, they protrude into the pin holes, and when assembled into the padlock body with the shorter ends towards the cam, they protrude into drive recesses but not into the pin holes.

Preferably, the first cam portion has a removal configuration enabling the removal of the shackle, the cam in the removal configuration presenting a longitudinally elongated, side, third recess, deeper than the second recess, to the second ball to enable the second ball to be removed from all the recesses of the longer leg, and wherein the cam is rotateable in the unlocking direction to the removal configuration while the stop remains in the second operative configuration, said removal configuration corresponding to the short leg being free of the casing.

Preferably each finger in the removal configuration of the cam abuts an associated second drive shoulder.

Preferably the padlock includes a torsion spring supported about the bridge having one end attached to the cam and the other within the offset recess to bias the cam towards the locking configuration.

Preferably, the padlock includes a compression spring within the longer recess to bias the shackle from the body.

Preferably, the cylinder is removable to provide accessibility to the cam to enable it to be rotated to the removal configuration while the stop remains undisplaced in the second operative position.

In a preferred embodiment, the cylinder is retained in the casing by a threaded fastener having a head accessible through the short recess, said cylinder barrel being free to rotate without limitation when the cylinder is removed from the casing.

In a preferred embodiment, the cylinder comprises an interchangeable core retained in the casing by a sideways protruding shoulder that is displaceable to withdraw into the core by the application of a control key, said cylinder barrel being free to rotate without limitation when the cylinder is removed from the casing.

Preferably, the cylinder comprises a pin cylinder having a casing with pin chambers extending from the surface of the casing, and wherein adjacent chambers adjacent the surface of the casing are joined by a channel, said channel accommodating a resilient elongated strip extending between the chambers and having substantially cylindrical portions extending one into each chamber.

According to the invention there is provided a padlock substantially as described herein with reference to and as illustrated in the accompanying drawings.

According to the invention there is provided padlock shackle having at least one locking recess having a surface substantially comprised of portions of surfaces of revolution, each portion having an axis of revolution which intersects the general form of the shackle to provide a surface portion extending on all sides from the axis of revolution, Preferably the shackle includes a locking recess comprising two such portions located adjacently and a small distance from an other recess each being joined by a channel portion.

Preferably the shackle is defined by two parallel co-planar legs; a short leg having a first locking recess and a longer leg having a second locking, substantially opposed, recess; the second locking recess being connected by a longitudinally elongated recess to a peripheral recess disposed towards the end of the longer leg, the surface of the first and second locking recesses being substantially comprised of portions of surfaces of revolution , each portion having an axis of revolution which intersects the general form of the shackle to provide a surface portion extending on all sides from the axis of revolution.

Preferably, the longitudinally elongated recess comprises a longitudinal channel of substantially uniform cross-section.

Preferably, the peripheral recess comprises a peripheral channel around the periphery of the shackle body of substantially uniform cross-section.

Preferably, the portions of surfaces of revolution comprise spherical portions defined by a radius substantially the same as the radii of the balls.

Preferably the channel cross-section is defined by a radius substantially the same as the radii of the balls.

Preferably, the channel cross-section is defined by a radius substantially the same as the radii of the balls.

According to the invention there is further provided a padlock shackle substantially as described herein with reference to and as illustrated in the accompanying drawings.

According to the invention there is further provided a padlock having a preferred padlock shackle.

According to the invention there is provided method of manufacture of a padlock shackle including advancing a rotating cutter blade into the side of an unformed shackle blank to manufacture a recess.

Preferably the method includes advancing a rotating cutter blade into the side of an unformed shackle blank and then advancing it longitudinally along the shackle body to manufacture a channel.

Preferably the method includes manufacturing a first and then a second locking recess by advancing a rotating cutter blade into the side of an unformed shackle blank and then partly withdrawing the cutter from the second locking recess and then advancing it longitudinally along the shackle blank to manufacture a channel, said longitudinal channel connecting to a pre-manufactured peripheral recess.

Preferably the method includes aligning the shackle blank so that the plane in which the axii of the spherical portions lie is orthogonal to the longitudinal axis of a mandrel, fixing a leg portion of the shackle blank within an elongated recess in a substantially tangential extension to the mandrel which includes an operating lever such that a reference portion of the shackle blank is retained adjacent to a cylindrical portion of the mandrel with the recesses disposed generally towards the mandrel, said reference portion comprising the junction between a leg and joining portion, positioning a roller adjacent the reference portion so that the shackle blank extends tangentially in relation to and from between the mandrel and roller, rotating the mandrel while maintaining the roller undisplaced to form the shackle blank into a shape corresponding to the mandrel to form the shackle body portion which joins the short and longer legs and to align the legs so that the longitudinal axii of the legs are substantially parallel.

Preferably the method includes surfaces of the roller and cylindrical portion of the mandrel, where they contact the shackle blank, comprise annular recesses having a semi-circular cross-section defined by a radius substantial the same as the radius of the shackle body.

Preferably the method includes the axis of the cutter being within a plane that intersects the longitudinal axis of the shackle blank.

DESCRIPTION OF THE DRAWINGS

Embodiments of the present invention will now be described by way of example only with reference to the accompanying drawings in which:

FIG. 1 is a schematic side view of a padlock with the shackle removed,

FIG. 2 is a schematic partial sectional view AA of the padlock of FIG. 1, FIG. 3 is a schematic partial sectional view BB of the padlock of FIG. 1, FIG. 4 is a partly cut away isometric view of the padlock of FIG. 1, FIG. 5 is an exploded, isometric view looking from above, of the cam and adjacent components, FIG. 6 is an exploded, isometric view looking from below, of the cam and adjacent components, FIG. 7 is an isometric view looking from below, of the cam and drive pins when configured for a Type 1 padlock, FIG. 8 is an isometric view looking from below, of the cam and drive pins when configured for a Type 2 padlock, FIG. 9 is a schematic side view of an unlocked, open padlock, FIG. 10 is a schematic partial sectional view AA of the padlock of FIG. 9, FIG. 11 is a schematic partial sectional view BB of the padlock of FIG. 9, FIG. 12 is a partly cut away isometric view of the padlock of FIG. 9, FIG. 13 is a schematic side view of an locked, closed padlock, FIG. 14 is a schematic partial sectional view AA of the padlock of FIG. 13, FIG. 15 is a schematic partial sectional view BB of the padlock of FIG. 13, FIG. 16 is a partly cut away isometric view of the padlock of FIG. 13, FIG. 17 are isometric views of the removed shackle showing the first and second locking recess and the longitudinal and peripheral recesses.

DESCRIPTION OF THE PREFERRED EMBODIMENTS

The invention provides improvements in padlocks including improvements in padlock shackles, cams and cylinders, and means for manufacturing padlocks including means for manufacturing shackles, cams and cylinders.

It is envisaged that elements of the invention, including the improved cam, shackle and cylinder be transported in other locking devices.

Improvements in padlocks reference two types of padlocks; a Type 1 padlock that may be opened while having the key removed from the cylinder, and a Type 2 padlock where the key cannot be removed unless the shackle is closed.

In preferred embodiments, the padlock can be converted between a Type 1 padlock and a Type 2 padlock by simply re-orientating a removeable sub-assembly, without the need for special tools and without additional parts or, alternatively by substituting one removeable sub-assembly for another.

In preferred embodiments, the padlock employs a removeable cylinder retained by a removeable screw, while in other improved padlocks, the padlock employs, what is commonly called, an interchangeable core which is removeable by the application of a control key.

In preferred embodiments the padlock employs a shackle of well known design comprising a pair of substantially parallel, preferably cylindrical, legs; one short leg and one longer leg, connected by a connecting portion preferably comprising an arcular portion of substantially circular cross-section. Towards the held end of the short leg and facing the longer leg is a first locking recess and directly opposite in the longer leg and facing the short leg is a second locking recess. Towards the end of the longer leg is a peripheral recess that is connected to the second locking recess by a longitudinally disposed flat. The locking recesses and flat comprise scallops, (surfaces longitudinally curved but transversely flat), in the side of the shackle body manufactured by broaching the shackle body from the side after the shackle body has been formed into the horse-shoe shape.

In other preferred embodiments, the padlock employs the shackle of improved design described below.

Figure 17:
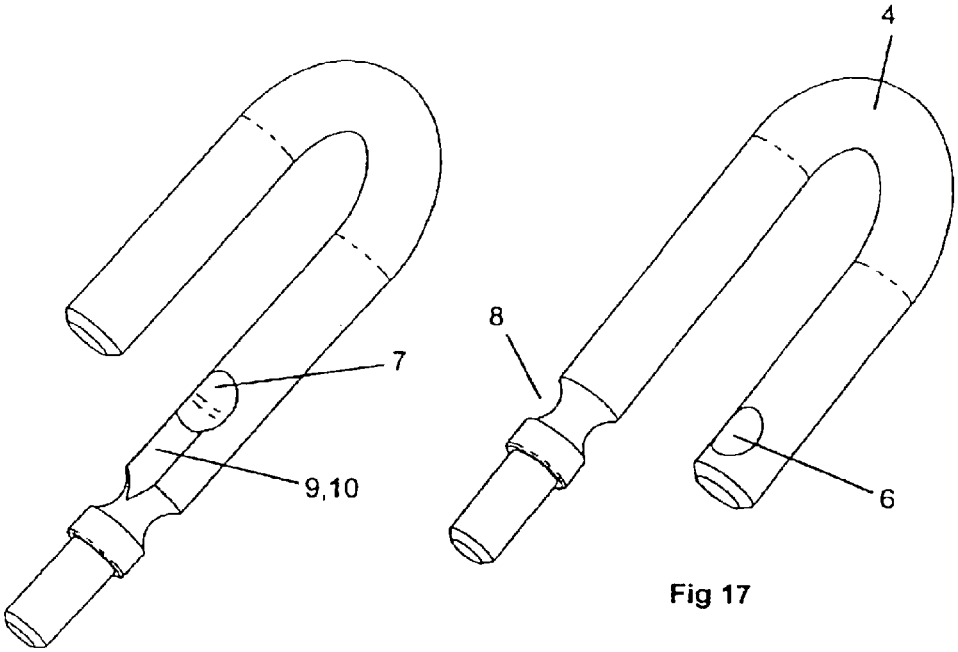

In preferred embodiments the padlock employs a shackle 1, as shown in FIGS. 4 and 17, comprising a pair of substantially parallel, preferably cylindrical, legs; one short leg 2 and one longer leg 3, connected by a connecting portion 4 preferably comprising an arcular portion of substantially circular cross-section. Towards the free end of the short leg 2 and facing the longer leg is a first locking recess 6 and directly opposite in the longer leg and facing the short leg 2 is a second locking recess 7. Towards the end of the longer leg is a peripheral recess 8 which is connected to the second locking recess by a longitudinally disposed flat 9 if the shackle is of conventional design or a longitudinally disposed channel 10 if the shackle is of improved design.

Figure 18:
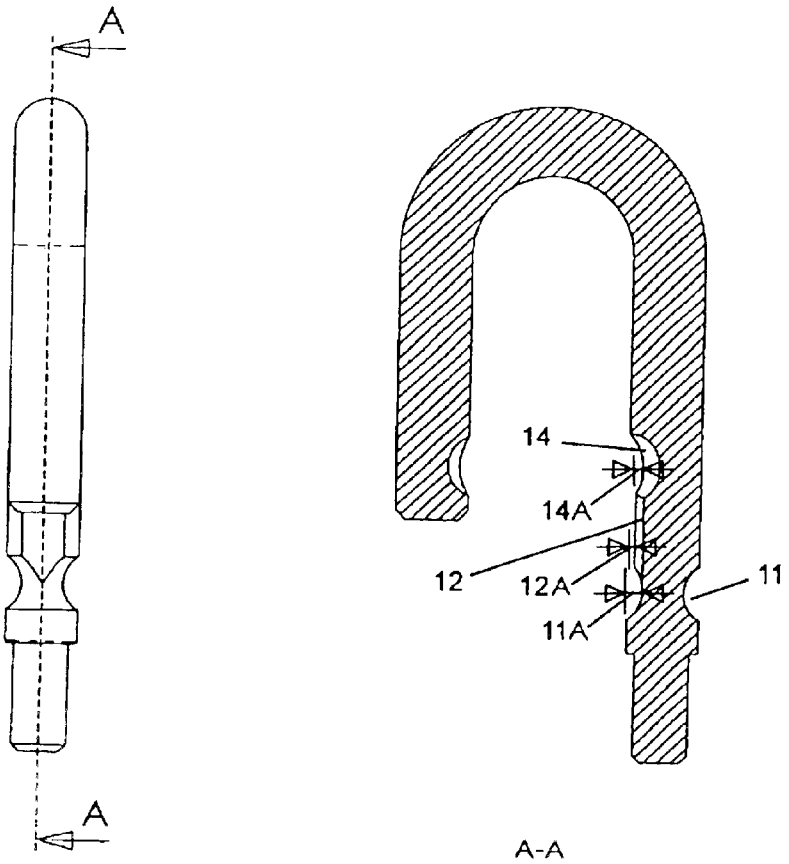
FIG. 18 is a sectional view defined by a plane which intersects the longitudinal axis of the shackle.
Figure 19:
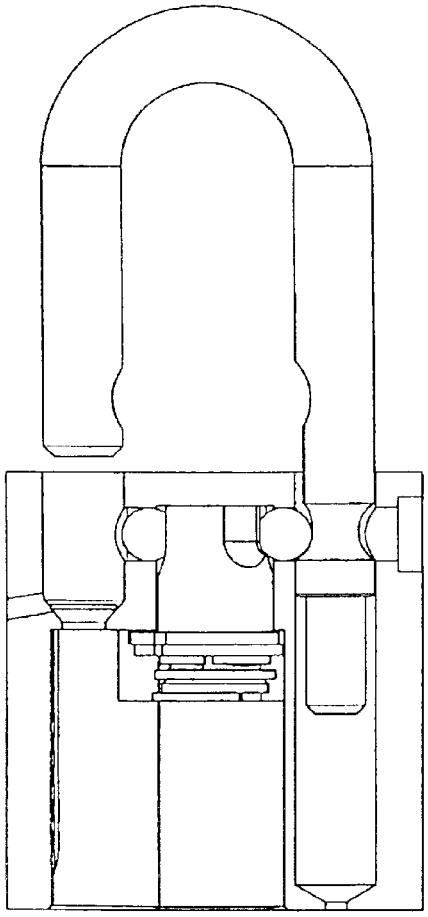
FIG. 19 is a schematic side view of a padlock employing a removeable cylinder.

If one considers a sectional view of the shackle, as shown in FIG. 18, defined by a plane which passes through the longitudinal axis of the legs of the shackle, then preferably, in relation to this view, the peripheral recess at the deepest point 11 defined by dimension 11A, and channel at the deepest point 12 defined by dimension 12A, (or flat at the deepest point if the shackle is of conventional design), are substantially the same depth from the inside edge of the shackle and a lesser depth than the second locking recess at the deepest point 14 defined by dimension 14A.

In preferred embodiments, as shown in FIGS. 1 to 4, the padlock includes a body 15, including a casing 16 having a short recess 17 extending into the casing from a first end surface 19 to receive the short shackle leg 2 and a longer recess 18 extending into the casing from the first end surface 19 to receive the longer shackle leg 3, and a transverse recess 20 in the vicinity of the first end surface 19 commencing at a first side surface 21 of the body and intersecting the deep and short bore and in the region of the short bore having a constriction 22 of reduced cross-section so the first locking ball 23 described below, cannot pass from transverse recess 20 into the short recess 17. Preferably the axis of the transverse recess 20 orthogonally intersects the axes of the short and deep recesses 17 and 18 which are preferably parallel and substantially cylindrical and in practice formed by a rotating cutter tool advance from the surface and into the padlock casing.

The padlock is configured such in a locked configuration, the short leg 2 including the first locking recess 6 is within the short recess 17 and the longer leg 3 including the second locking recess 7 is within the longer recess 18 and additionally, the locking recesses 6 and 7 are aligned with the transverse recess 20. Preferably, in the locked configuration, the deepest point of the second locking recess 14 is substantially co-axial with the axis of the cross-recess.

In the locked configuration, FIGS. 13 to 16, the first ball 23 locates partly within the first locking recess 6 and partly in the transverse recess 20 and a second locking ball 24 lies partly in the second locking recess 7 and partly within the cross recess 20. Between the balls is a displaceable, (preferably angularly displaceable), cam 25 of varying cross-section. In the locked configuration, the balls abut a cylindrical side surface 26 of the cam, this engagement preventing the balls from moving inwardly to release the shackle legs.

When the cam is in the unlocked configuration, as shown in FIGS. 9 to 12, the first ball 23 is partly within a first unlocking recess 27 of the cam and completely withdrawn from the first locking recess 6 in the short leg to thereby release the short leg.

Opposite this first unlocking recess 27 is a second, less deep similar second unlocking recess 28. When the cam is in the unlocked configuration and the short leg is released from the body, the second ball is partly within the unlocking recess 28 and partly within the peripheral recess or flat 9 or channel 10 depending on the shackle configuration. When the second ball is retained in this flat or channel the shackle may be moved longitudinally in relation to the casing. When the second ball 24 is in the second cam unlocking recess 28 and partly within the peripheral recess the shackle can be rotated in relation to the body while being retained in the body.

The casing is defined by a first end surface 19 referred to above, an opposed second end surface 29, a first side surface 21 referred to above, an opposed second side surface 30, a front surface (not shown) and back surface 32.

Coaxial with the axis of rotation of the cam and commencing at the second end surface 29 is a central recess 33 which extends towards the transverse recess 20 to intersect the transverse recess and to provide a recess to accommodate the cam. Adjacent to the central recess 33 is an offset recess 34 of lesser depth, having a longitudinal axis parallel to that of the central recess and displaced sideways from that of the central recess such that this recess is intercepted by the axis of the short recess 7. The offset recess has a depth not so great as to intersect recess 17 by which it is separated by a bridge portion 35. The central recess and offset recess preferably comprise cylindrical recesses having axii parallel to those of the recesses 17 and 18 recess and together form a chamber of a generally FIG. 8 cross-section to accommodate a cylinder of similar cross-section. In preferred embodiments, the central recess comprises a cylindrical recess joined to coaxial cylindrical of smaller diameter which houses the cam.

Alternatively, the offset recess comprises a parallel sided oval so that together the oval and offset recess form a pear shaped recess to accommodate a cylinder of common European profile. And alternatively again, the combined recesses are of FIG. 8 cross-section configured to accept an interchangeable core in which case the offset recess need not be intercepted by the axis of the short recess 7.

The offset bore extending towards the short bore provides the bridge portion 35 between these recesses 34 and 17. In embodiments not employing an interchangeable core, this bridge portion includes an aperture 36 which extends from the recess 17 to the offset recess 34 to provide passage for a fastener by which the cylinder is fastened into the padlock casing. Preferably the fastener comprises a countersunk head screw 37 and the recess 17 is adapted by the inclusion of a conical recess to accommodate the screw head; the screw shank passing through the aperture 36 to engage in a threaded recess within the cylinder to retain the cylinder within the combined recesses. Preferably, the screw is thread-forming and forms a thread in the cylinder when it is inserted thereby precluding the need for a tapped hole in the cylinder, which otherwise must be provided.

In preferred embodiments, the shackle is easily removed from the body. In these embodiments the cam includes an additional release recess 38, as shown in FIG. 5, similar to the unlocking recesses and having a configuration such that when the second locking ball 24 is in the release recess, the second ball is completely withdrawn from the longer shackle, i.e. completely withdrawn from the peripheral recess in the longer leg to thereby release the shackle and enable it to be removed from the body.

The cam comprises a member 25 defined by a first end face 40 adjacent to the closed end of the central recess 33, an opposed second end 41 and a side wall therebetween. In preferred embodiments the cam comprises a substantially cylindrical member defined by a substantially circular first end face 40 and the unlocking recesses 27 and 28 and the release recesses 38 are defined by partial cylindrical surfaces which extend from the first end face 40 towards the second end 41 a distance to provide free movement of the balls into the respective recesses.

Preferably, each of these recesses 27 and 28 is formed by advancing a rotating cutter blade having an axis of rotation parallel with that of the cam and which overhangs the cam, from the first end face towards the second end.

Figure 20:
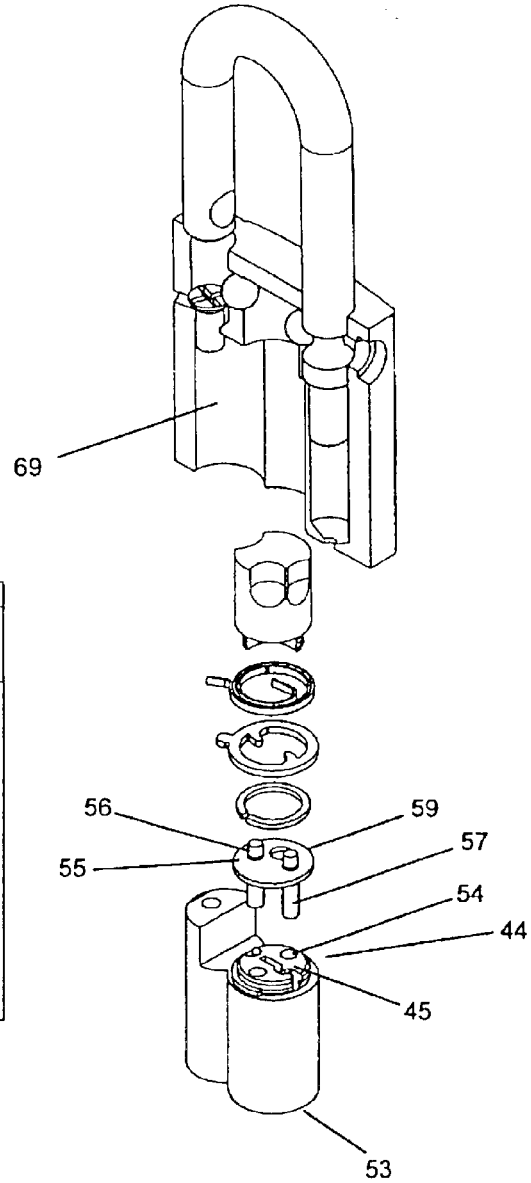
FIG. 20 is a partly cut-away exploded, isometric view looking from above, of the padlock of FIG. 19.
Figure 21:
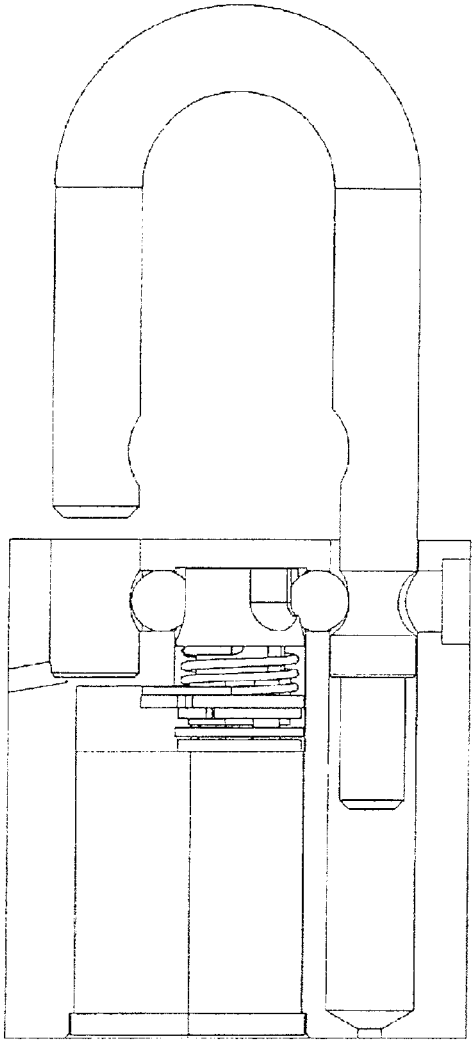
FIG. 21 is a schematic side view of a padlock employing an interchangeable core.
Figure 22:
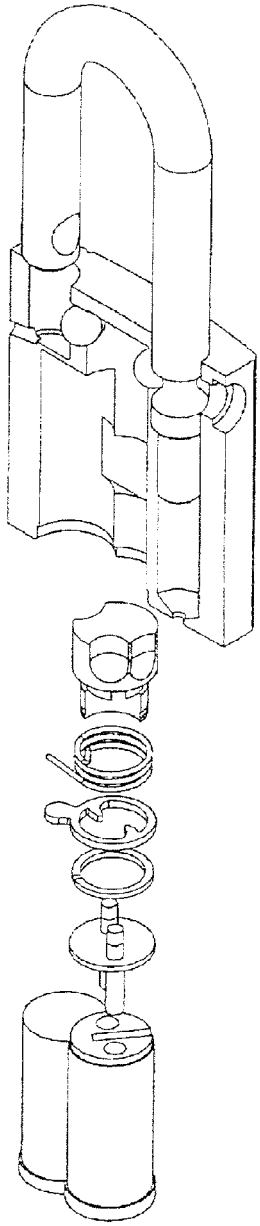
FIG. 22 is a partly cut-away exploded, isometric view looking from above, of the padlock of FIG. 21.

In preferred embodiments, as shown in FIG. 5, the second end comprises a drive portion 42 having a second end face 43 disposed towards the inner end 44 of the cylinder barrel 45 as shown in FIG. 20. A torsional spring 47 surrounds the drive portion. The drive portion has two opposed drive recesses 48 and 49 extending from the second end face 43 towards the first end face 40. Between the drive recesses is a bridge 50 defined by the opposed drive shoulders 51 and 52 that comprise the walls which defining the drive recesses 48 and 49 respectively.

Preferably, the drive portion is substantially cylindrical in form but of reduced cross-sectional diameter so as to accommodate the spring within the normal diameter of the central recess and preferably the drive recesses are partial cylindrical in shape having between them a bridge of fan shape. The drive recesses are manufactured by advancing a rotating cutter blade having an axis of rotation parallel with that of the cam and which overhangs the cam, from the second end face 43 towards the first end.

As shown in FIGS. 5 to 8 and 20, projecting from the surface of the inner end 44 of the barrel towards the key entry end 53 of the barrel, are two pin recess 54 each having an axis parallel to that of the barrel. Adjacent to the inner end 44 is a disc-like member 55 having pin apertures 56 coaxial with the pin recesses 54 but of small diameter. Within the barrel are longitudinally elongated pins 57 that have passage through the member 55 to comprise pin extensions 58 which extend from the member 55 towards the cam. Preferably, at the point of intersection with the member 55 they reduce in diameter to the diameter of the apertures 56 to be restrained by member 55 from displacing towards the cam. Preferably the pins 57 and member 55 comprise a separate sub-assembly 59, which in practice is inserted into the barrel as one. The pin extension is a shorter length than the balance of the pin by a given distance.

These pins, extending towards the cam extend into the drive recesses 48 and 49 to longitudinally overlap the drive shoulders 51 and 52—this arrangement operably coupling with free movement the cam to the barrel so that the barrel may be turned to angularly displace the cam. Preferably the pins are disposed diagonally opposite one on each side of the keyway in the keyway.

The cam torsion spring 47, surrounding the drive portion 42 of the cam is located axially disposed from the barrel and having a moveable end 60 held in one of the drive recesses to abut a portion of the associated drive shoulder and a fixed end 61 projecting into the offset recess to abut a portion of the offset recess wall. It is configured to bias the cam away from the unlocked configuration and towards the locked configuration. Alternatively, the end 60 comprises a spring return which extends are short distance in a direction parallel to the axis of the cam to mate in a recess commencing at the floor of a drive recess and extending towards the first end surface.

A stop means 62 is included in the cam assembly to prevent the cam from being rotated by the spring in an unlocking direction from the unlocked configuration, i.e. too far in an unlocking direction. Preferably, the stop means comprises an annular member 63 that straddles the bridge 50 to be supported by the bridge to be relatively angularly displaceable.

Preferably the cam comprises a sub-assembly of components where the spring is retained between the portion of the cam having the larger diameter and the member 63 that is retained by a circlip 64 located towards the second end face 43, said circlip locating behind a raised shoulders of the bridge.

In the locked configuration the spring biases the cam in a direction towards the locked configuration from the unlocked configuration of the cam, and to assist in later description, we define clockwise as being the locking direction.

The annular member 63 has two opposed substantially radially inwardly projecting wedges 65 and 66, (also called herein fingers 65 and 66 respectively), that are located one in each drive recess 48 and 49 respectively and an outwardly projecting stop 66A that protrudes into the offset recess. The cam and stop are configured such that when the cam is in the locked configuration, as shown in FIGS. 13 to 16, these wedges 65 and 66 abut end portions 67 and 68 respectively of the drive shoulders 51 and 52 respectively to restrain the cam from rotating in a clockwise direction while the stop itself is restrained from rotating clockwise by the stop abutting a first wall 69 of the offset recess.

In the locked configuration, the pin extensions 57 protrude longitudinally one into each locking recess to be longitudinally adjacent a wedge to be engageable with the wedge.

Rotation of the barrel, as shown in FIGS. 9 to 12, in an anticlockwise direction from the locked configuration causes the pin extensions 57 to engage the wedges 65 and 66 to urge the stop 66A and annular member 63 to rotate in an anticlockwise direction but in so doing the wedges 65 and 66 simultaneously engage the drive shoulders end portions 67 and 68 respectively to cause the cam to rotate in an anticlockwise direction, and in practice the whole cam assembly rotates substantially simultaneously and the same amount in an anticlockwise direction until the stop 66A engages the opposite wall 70 of the offset recess; this latter configuration corresponding to the unlocked position of the cam.

When the cam is in the unlocked position and the shackle peripheral recess is engaged with the second ball the second ball being in the second unlocking recess in the cam prevents the cam from angularly displacing—the cam having been angularly displaced to this configuration by turning the barrel to rotate the pins. In the Type 1 padlock the key must then be reversible to the key withdrawal, undisplaced position so the drive recesses are configured to have free space 71 within drive recess 48 and free space 72 within drive recess 49 to accommodate this displacement of the barrel and pins while the cam remains restrained from displacing by the second ball.

As shown in FIG. 6, commencing at the floor of each drive recess 48 and 49, extending towards the first end surface, and having an axis parallel to that of the cam are two elongated additional recesses 73 positioned such that in the unlocked configuration of the cam the axis of these recesses are coaxial with an axis of the pin recesses 54 in the barrel. Preferably, the diameters of the additional recesses are substantially the same as the diameter as the pin recesses 54.

In a padlock having a cylinder the pin sub-assembly 59 is configured such that, when the pin extensions 58 protrude towards the cam they protrude into the drive recesses 48 and 49 but they do not protrude far enough to engage in the additional recesses 73—this configuration corresponding to a Type 1 padlock. In a Type 1 padlock, when the cam is in the unlocked position and the shackle peripheral recess is engaged with 30 the second ball the second ball being in the second unlocking recess in the cam prevents the cam from angularly displacing but because of the free spaces between the drive pins and drive shoulders the barrel and attached drive pins can be rotated to the key withdrawal position. Preferably, the Type 1 padlock includes a compression spring 18A supported in the longer recess 18 and employed to outwardly bias the longer shackle leg. It has a free length requiring it to be compressed when the shackle is inserted in the casing.

If the pin sub-assembly is orientated such that the extensions are within the pin holes in the barrel and the pin portions of larger diameter project from the barrel then they project into the drive recesses then further to project into the additional recesses 73 to directly couple the cam to the barrel without significant free movement—this configuration corresponding to a Type 2 padlock. In a Type 2 padlock, when the cam is in the unlocked position and the shackle peripheral recess is engaged with the second ball the second ball being in the second unlocking recess in the cam prevents the cam from angularly displacing and hence the barrel cannot be rotated to the key withdrawal position.

By simply changing the orientation of the pin sub-assembly, the padlock can be reconfigured between a Type 1 and Type 2 padlock.

When the cylinder is removed from the padlock by use of the control key or removal of the screw according to which cylinder is employed, the cam may be rotated in an unlocking direction an additional amount and until the release recess 38 aligns with the second ball—this recess being sufficiently deep to allow the second ball to withdraw completely from the longer shackle thereby enabling the shackle to be removed from the body.

A hand tool, such as pliers, is used to displace the cam anti-clockwise, (against the action of the spring) in the unlocking direction from the unlocked configuration while the annular member remains undisplaced with the stop 66A abutting wall 70.

Preferably, as shown in FIGS. 1 to 4, the release recess is angularly disposed such that the cam is displaced until the end shoulders 67A and 68A engage the wedges 65 and 66 simultaneously to restrain the cam from rotating further in an anti-clockwise direction; shoulders 67A and 68A being the other end shoulders associated with the shoulders 67 and 68 respectively.

Preferably, each of the drive recesses 48 and 49 is formed by advancing a rotating cutter blade having an axis of rotation parallel with that of the cam and which overhangs the drive portion 42 from the second end face 43 towards the first end face. Preferably the annular member comprises a metal pressing.

Many variations of the above-described embodiments also come within the scope of the invention, including:

- the padlock having a single drive recess, a single drive pin, and a single drive shoulder.
- the padlock having a pair of drive recesses, a drive pins, and drive shoulders.
- the cam being without a release recess.
- the Type 2 padlock being without a torsion spring.
- the padlock including a cylinder of other cross-section.

In preferred embodiments, at least one of the shackle recesses comprises a portion or portions of surfaces of revolution in which the axis of revolution defining the surface intersects the body of the shackle and where the surface of the recess extends in all directions from the axis. Preferably the axii of the aforementioned surfaces are parallel and preferably a plane through the axii also intersects the longitudinal axis of the shackle.

The first and second locking recesses preferably comprise a portion or portions of surfaces of revolution as described above. Alternatively, the second locking recess comprises two such portions located adjacently a small distance apart and joined by a channel portion.

The longitudinally elongated recess preferably comprises a channel defined by a uniform cross-section.

Preferably, each of the surfaces of revolution are spherical and are defined by a radius and preferably this radius is substantially the same as the radius of the balls. Preferably the cross-section of the longitudinally elongated channel is defined by a radius and preferably this radius is substantially the same as that of the radius of the balls.

Figure 23:
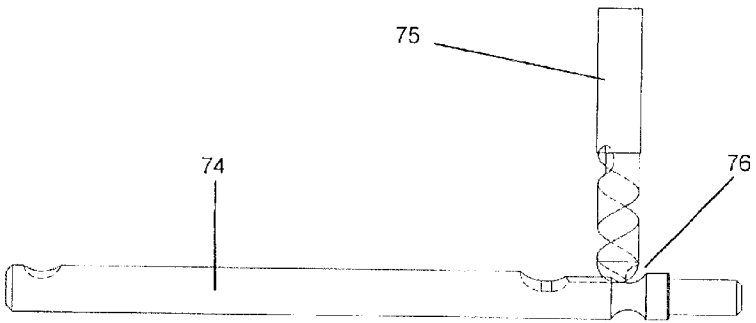
FIG. 23 is a schematic side view of a cutting tool and shackle blank.

It is envisaged that this improved shackle construction be employed in all types of locks and not just those described herein, including:

- a padlock employing only a first locking recess and first ball
- a padlock employing only a second locking recess and second ball
- a padlock where the shackle comprises a cable connected to a solid cylindrical end portion having a first locking recess and the other end is secured to the padlock body.
- a padlock where the shackle comprises a cable connected on one end to a solid cylindrical end portion having a first locking recess and the other end is connected to a solid cylindrical end portion having a second locking recess.
- a lock the shackle comprises an elongated member having a first locking recess The preferred shackle is manufactured by turning bar on a lathe or similar machine tool to produce a shackle blank 74, as shown in FIG. 23, having chamfered or radiused ends and the peripheral recess. The first and second locking recesses are formed by advancing a rotating cutter tool 75, preferably having a spherical end 76 defined by a radius similar to that of the ball into the shackle blank or partly manufactured shackle plant, to manufacture a recess having a surface comprising a surface of revolution.

In an alternative embodiment, the second locking recess is constructed firstly by advancing a cutter into the shackle blank as described above and then advancing it a short distance, while it is cutting, longitudinally along the shackle blank.

The longitudinal recess is manufactured by manufacturing the second locking recess and then withdrawing the cutter partly from the formed second locking recess and advancing it, while it is cutting, longitudinally along the shackle blank towards the peripheral recess till the cutter is aligned with peripheral recess. Preferably the cutter tool has a spherical end defined by a radius similar to that of the ball.

Preferably the axis of the cutter tool lies in the same plane as the longitudinal axis of the shackle blank.

Figure 24:
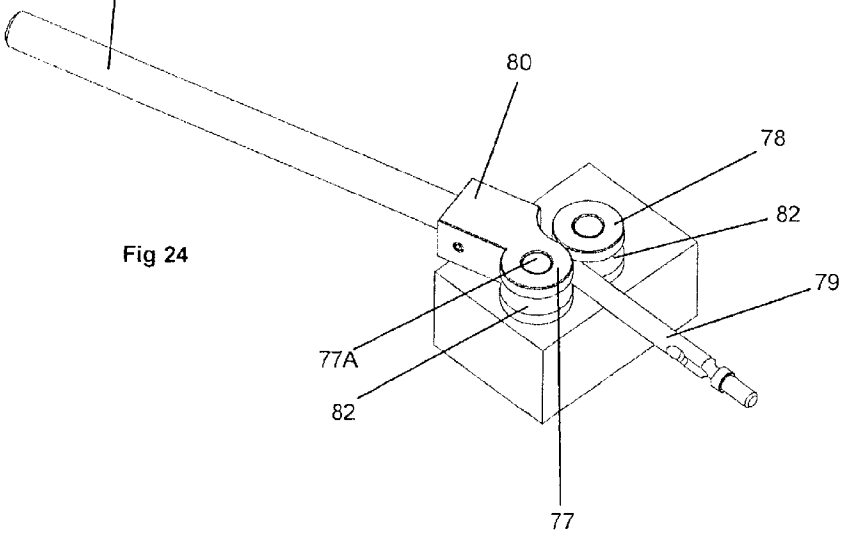
FIG. 24 is a schematic, isometric view of the shackle blank being formed.

After machining, the shackle blank is aligned so that the plane in which the axii of the surfaces of revolution lie is orthogonal to the axis of an angularly displaceable mandrel 77 about which the shackle will be formed, as shown in FIG. 24—the mandrel being supported on a shaft 77A. The shackle blank 79 is retained adjacent the cylindrical mandrel with the axii pointing towards the mandrel and the junction between the short leg and joining portion touching the side of the mandrel. A roller 78 is located on the other side of the shackle blank so that the shackle blank is between the roller and mandrel and touches both. The mandrel adjacent the shackle blank has a tangential extension comprising a holding block 80 which has an aperture in which to support a leg portion of the shackle and a lever portion 81. The shackle is retained in the aperture by a fastener. Rotation of the lever causes the mandrel and attached block to rotate around the mandrel axis of rotation, while the roller remains fixed but free to rotate, to form the shackle blank in a shape corresponding to the mandrel. In this way the shackle blank is formed to have parallel legs.

Preferably, the short leg which is retained in the block comprising part of the mandrel. Preferably the aperture has a cross recess through which a spherical headed fastener has passage to be displaced firmly into the first locking recess of the shackle blank. Preferably, the surfaces of the roller and cylindrical portion of the mandrel, where they contact the shackle body, comprise recesses having a semi-circular cross-section 82 defined by a radius substantial the same as the radius of the shackle body.

The removeable cylinder has a number of transverse pin chambers in the cylinder housing each extending from a portion of the outer surface of the housing to meet coaxially with a pin chamber in the barrel when the key is removed. The longitudinal axii of the chambers are substantially on the same plane when the key is withdrawn. The apertures in the surface where the recesses intersect the surface are plugged to prevent the pins and other components from escaping. Commonly each aperture is plugged with an individual cylindrical plug but preferably the casing between the apertures is connected by a channel which extends to the inner end of the casing and preferably the plug comprises a strip of resilient material such as plastic which occupies the channel and that has substantially cylindrical extensions which extend into each pin chamber. Preferably the extensions are radially compressible and, in part at least, are of a diameter slightly larger than the chambers so that after being pressed into the chambers they exert a radial force on the walls of the chambers—the chambers in turn exerting a reactionary force on the extensions to retain the extensions within the chambers. When re-pinning is required the strip can be quickly peeled from the cylinder to provide access to the chambers and then quickly reapplied.

This means of capping pin apertures is applicable to all pin cylinders, (not just that described herein), in which the apertures are inaccessible once the cylinder is installed into the padlock or lock in which it is employed.

Throughout this specification and claims that follow, unless the context requires otherwise, the word "comprise", or variations such as "comprises" or "comprising", will be understood to imply the inclusion of a stated integer or group of integers but not the exclusion of any other integer or group of integers.

Throughout this specification and claims that follow, unless the context requires otherwise, the positional prepositions such as rear, forward are used to assist in description of the preferred embodiments and have in general no absolute significance.

What is claimed is:

1. A padlock, including a shackle having a short leg with a first locking recess and a longer leg having an opposed second locking recess, said opposed second locking recess being connected by a longitudinally elongated recess to a peripheral recess disposed towards the end of the longer leg, and a casing having a short and a longer recess extending into the casing from a first end surface to accept the short and longer shackle leg respectively, a central recess extending into the casing from an opposed second end surface, an offset recess extending into the casing from the opposed second end surface and intersecting the central recess, the intersection defining a first and a second longitudinally elongated cusp portions, said short, longer and central recesses being intersected by a transverse recess extending into the casing from a first side of the casing, a cylinder having a key operable barrel characterized by an undisplaced position enabling key removal, two opposed balls supported within the transverse recess; a first ball to protrude into the short recess and first locking recess and a second ball to protrude into the longer recess and second locking recess, a cam including a first cam portion to control the balls and a cam drive portion that includes opposed drive recesses, the cam operable by the barrel through an interspaced coupler that projects towards the cam to occupy holes within the cain drive recesses while being supported in barrel drive recesses to provide a Type 2 padlock, the cam operable by the barrel through an interspaced coupler that projects towards the cam to occupy the two drive recesses without projecting into said holes within the cam drive recesses while being supported in barrel drive recesses to provide a Type 1 padlock, said Type 1, padlock being characterized by an open configuration where the short leg is free of the casing, the longer leg is supported in the casing and the key is removable, said Type 2 padlock being characterized by an open configuration where the short leg is free of the body, the long leg is supported in the body casing and the key and barrel cannot be rotated to the undisplaced position to enable key removal.

2. A padlock according to claim 1, wherein the first cam portion comprises a substantially cylindrical portion having a peripheral curved side surface defined in part by a longitudinal axis coaxial with an axis of rotation of the cam and which is parallel with and between longitudinal axii of the short and longer recess in the casing, said cam in a locking configuration presenting the curved side surface to each ball to retain each ball in its corresponding locking recess, said cam in the unlocking configuration presenting a first unlocking side recess to the first ball and a second unlocking side recess to the second ball to enable the first ball to be removed from the first locking recess and the second ball to be partly removed from the second locking recess and be retained partly within the longitudinally elongated recess or partly within the peripheral recess.

3. A padlock according to claim 1, wherein an angular disposition of the first cam portion in the locking and unlocking configurations is determined by a stop member being part of the cam, said stop member being an outwardly projecting finger of the a disc-like member supported coaxially with and relative to the first cam portion, said stop member protruding into the offset recess, said stop member being displaceable between a first operative configuration where the outwardly projecting finger abuts the wall of the offset recess adjacent the first cusp and a second operative configuration where the outwardly projecting finger abuts the opposite wall of the offset casing, the padlock being further characterized by:

a locked configuration corresponding to the stop member being in the first operative configuration, the short and longer legs being supported in the casing and restrained from displacing relative to the casing, the cam being in a locking configuration retaining the first ball partly within the first locking recess and the second ball being partly within the second locking recess, the cam and stop member being rotateable in an unlocking direction by the cylinder to displace the padlock to an unlocked configuration, and an open, unlocked configuration corresponding to the stop being in the second operative configuration, the short leg being free of the casing, the longer leg being supported in the casing, and the cam being in an unlocking configuration retaining the second ball partly within the longitudinally elongated recess or partly within the peripheral recess.

4. A padlock according to claim 1, configured as a Type 1 padlock, wherein the coupler comprises an opposed pair of drive pins supported by the barrel and wherein the coupler is displaceable about an axis of rotation of the barrel to displace the cam to the unlocking configuration and the barrel and key to subsequently be returned to the undisplaced position while each drive pin correspondingly displaces freely within a drive recess.

5. A padlock according to claim 1, configured as a Type 2 padlock, wherein the coupler comprises an opposed pair of drive pins supported by the barrel and wherein the coupler is displaceable about an axis of rotation of the barrel to displace the cam to the unlocking configuration whereupon the barrel and key become restrained from displacing to the undisplaced position by each drive pin being within a hole.

6. A padlock according to claim 1, wherein the coupler comprises an opposed pair of drive pins supported by the barrel, said drive pins having passage through while being supported in a support disc to comprise a subassembly to comprise the coupler, the drive pins being configured to protrude more from one side of the support disc than the other and additionally being configured so that when assembled into the padlock casing with the longer ends towards the cam, they protrude into the holes in the cam whereby to provide a Type 2 padlock, and when assembled into the padlock casing with the shorter ends towards the cam, the drive pins protrude into the drive recesses but not into the holes in the cam whereby to provide a Type 1 padlock.

7. A padlock according to claim 2, wherein the first cam portion has a removable configuration enabling the removal of the shackle, the cam in the removal configuration presenting a third side recess, deeper than the second recess, to the second ball to enable the second ball to be removed from all the recesses of the longer leg, said removal configuration corresponding to the long leg being capable of being free of the casing.

8. A padlock according to claim 2, including a torsion spring supported within the cam, said torsion spring having one end attached to the cam and another end within the offset recess to bias the cam towards the locking configuration.

9. A padlock according to claim 4, including a compression spring within the longer recess to bias the shackle from the body.

10. A padlock according to claim 1, wherein the cylinder is displaceable relative to the casing to be removable and to provide accessibility to the cam and to enable the cam to be displaced to a removal configuration wherein the shackle is removable.

11. A padlock according to claim 1, wherein the drive recesses are defined in part by drive shoulders.

12. A padlock according to claim 1, wherein the cylinder comprises an interchangeable core retained in the casing by a sideways protruding shoulder that is displaceable to withdraw into the core by the application of a control key.

13. A padlock shackle according to claim 1, wherein the longitudinally elongated recess comprises a channel.

14. A padlock shackle according to claim 1, wherein the peripheral recess comprises a peripheral channel around the periphery of the shackle body.

15. A padlock shackle according to claim 14, wherein a cross-section of the channel is defined by a radius substantially the same as the radii of the second ball.

16. A padlock including a casing, comprising:

a cylinder having a key operable barrel characterized by an undisplaced position enabling key removal, two opposed balls supported within a transverse recess; a first ball to protrude into a short recess and a first looking recess and a second ball to protrude into a longer recess and a second locking recess, a cam including a first cam portion to control the balls and a cam drive portion that includes opposed drive recesses, the cam operable by the barrel and key through an interspaced coupler comprising pins that project into holes within the cam's opposed drive recesses while being supported in barrel drive recesses to provide a Type 2 padlock, the cam operable by the barrel through an interspaced coupler with said pins that project into the two drive recesses without said pins projecting into said holes within the cam drive recesses while being supported in the barrel drive recesses to provide a Type 1 padlock, said Type 1 padlock being characterized by an open configuration where a short leg of a shackle is free of the casing, a longer leg of the shackle is supported in the casing and the key is removable, said Type 2 padlock being characterized by an open configuration where the short leg of the shackle is free of the body, the long leg of the shackle is supported in the body casing and the key and barrel cannot be rotated to the undisplaced position to enable key removal.

17. A padlock with a casing, comprising:

a barrel, said barrel being operable by a key;

a cam, said cam comprising drive recesses and drive holes; and a coupler for coupling said barrel with said cam, said coupler comprising opposed pins; wherein said pins are invertible, and, when said pins are in a first position and the padlock is open, said pins engage said barrel with said cam by being inserted into said drive holes, wherein said key cannot be removed from said barrel; and when said pins are in a second position and the padlock is open, said pins engage said barrel by being inserted into said drive recesses, wherein said key can be removed from said barrel.

* * * * *